US008302873B2

(12) United States Patent
Hiura et al.

(10) Patent No.: US 8,302,873 B2
(45) Date of Patent: Nov. 6, 2012

(54) AIR CONDITIONER HAVING PLEASANT SLEEP DRIVING MODE

(75) Inventors: Masahiro Hiura, Ora-gun (JP); Keiji Nishida, Ota (JP); Akira Shindo, Ota (JP); Atsushi Niizato, Ashikaga (JP); Masayuki Ishizeki, Ota (JP); Yuichi Suzuki, Ota (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 597 days.

(21) Appl. No.: 11/624,874

(22) Filed: Jan. 19, 2007

(65) Prior Publication Data

US 2007/0169490 A1 Jul. 26, 2007

(30) Foreign Application Priority Data

Jan. 20, 2006 (JP) ..... 2006-013078

(51) Int. Cl.
*F24F 11/053* (2006.01)
*F23N 5/20* (2006.01)

(52) U.S. Cl. ..... 236/1 C; 236/46 R

(58) Field of Classification Search ..... 236/1 C, 236/46 R, 91 D, 91 E; 62/157
See application file for complete search history.

(56) References Cited

U.S. PATENT DOCUMENTS

| | | | | |
|---|---|---|---|---|
| 4,347,974 | A * | 9/1982 | Pinckaers et al. | 236/46 R |
| 4,442,972 | A * | 4/1984 | Sahay et al. | 236/1 EA |
| 4,702,413 | A | 10/1987 | Beckey et al. | |

FOREIGN PATENT DOCUMENTS

| | | |
|---|---|---|
| JP | 05099472 | 4/1993 |
| JP | 09170797 | 6/1997 |
| JP | 2001201136 | 7/2001 |
| JP | 2004-093066 A | 3/2004 |
| JP | 2004092918 | 3/2004 |
| JP | 2006162168 | 6/2006 |
| JP | 2006317074 | 11/2006 |

* cited by examiner

*Primary Examiner* — Cheryl J Tyler
*Assistant Examiner* — Travis Ruby
(74) *Attorney, Agent, or Firm* — Westerman, Hattori, Daniels & Adrian, LLP

(57) ABSTRACT

An air conditioner having a pleasant sleep driving mode including a parameter changing unit (142) for independently changing the respective values of plural parameters for determining a variation pattern of the set room temperature, and a controller (42) for receiving the changed parameters from the parameter changing unit (142) and controlling the operation of the air conditioner according to the pleasant sleep driving mode having the variation pattern of the set room temperature determined by the changed parameters.

8 Claims, 4 Drawing Sheets

FIG.3

(A)

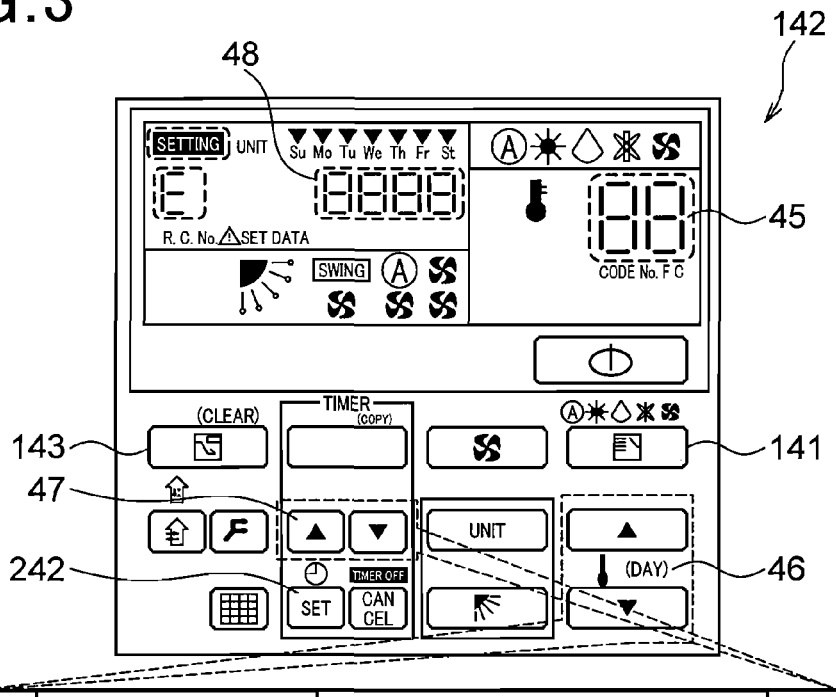

(B)

| DN | ITEM | | CONTENT | SET DATA (INITIAL VALUE) |
|---|---|---|---|---|
| 0B | PROHIBITION OF NIGHT SETBACK | | 0=PERMISSION<br>1=PROHIBITION OF NIGHT SETBACK | 0 |
| 0C | CONSTANT-TEMP. NIGHT SETBACK | | 0=NORMAL NIGHT SETBACK<br>1=CONSTANT-TEMP. NIGHT SETBACK | 0 |
| 0D | END OF NIGHT SETBACK | | 0=STOP<br>1=RETURN TO DRIVING STATE BEFORE NIGHT SETBACK | 0 |
| 0E | AIR BLOWING SPEED OF NIGHT SETBACK | | 0=INVALID<br>1=STOP<br>2=AUTOMATIC<br>3=QUICK AIR<br>4=STRONG AIR<br>5=WEAK AIR<br>6=SIGHT AIR | 0 |
| 0F | NIGHT SETBACK DRIVING TIME | | | 7 |
| 10 | COOLING (DRY) | DNSTEP | TEMPERATURE a | 2 |
| 11 | | | TIME b | 1 |
| 12 | | UPSTEP | TEMPERATURE d | 1 |
| 13 | | | TIME c | 2 |
| 14 | HEATING | DNSTEP | TEMPERATURE a | 4 |
| 15 | | | TIME b | 2 |
| 16 | | UPSTEP | TEMPERATURE d | 2 |
| 17 | | | TIME c | 2 |
| 18 | NIGHT/POWER SAVE SWITCH | | 0=NIGHT SETBACK<br>1=POWER SAVE | 0 |

AIR CONDITIONER HAVING PLEASANT SLEEP DRIVING MODE

INCORPORATION BY REFERENCE

The present application claims priority under 35 U.S.C. §119 to Japanese Patent Application No. 2006-013078 filed on Jan 20, 2006. The content of the application is incorporated herein by reference in its entirety.

BACKGROUND OF THE INVENTION

1. Field of the Invention

The present invention relates to an air conditioner having a pleasant sleep driving mode in which the room temperature is temporarily reduced and then gradually increased.

2. Description of the Related Art

There is known an air conditioner having a so-called pleasant sleep driving mode which can be set by pushing a dedicated button before a user goes to bed under cooling, dry or heating operation. According to this pleasant sleeping driving mode, the room temperature is temporarily reduced, and then gradually increased. Accordingly, the reduction of the body temperature of the user during sleep is promoted under the state that the room temperature is reduced, and then the room temperature is slowly increased to make such an environment as to promote increase of the body temperature, thereby assisting the user to awake with a pleasantly refreshed feeling (for example, see JP-A-2004-93066).

However, the foregoing air conditioner has a problem that when the room temperature is temporarily reduced and then gradually increased, it is impossible to adjust the reduction rate or increase rate of the room temperature, and thus the degree of freedom for the adjustment of the room temperature is little.

Furthermore, according to the foregoing air conditioner, in order to set the pleasant sleep driving mode, a user inputs a scheduled driving time for which the user wants to actually drive the air conditioner in the pleasant sleep driving mode, however, the user cannot easily judge what time in the night the pleasant sleep driving after the setting is finished at.

SUMMARY OF THE INVENTION

Therefore, the present invention has been implemented to solve the foregoing problem, and has an object to provide an air conditioner that can enhance the degree of freedom of room temperature adjustment in a pleasant sleep driving mode, and also enables a user to easily recognize (select) at what time in the night the pleasant sleep driving is finished, for example.

In order to attain the above object, according to the present invention, an air conditioner having a pleasant sleep driving mode in which a set room temperature is first reduced and then gradually increased, comprises: a parameter changing unit (142) for independently changing the respective values of plural parameters for determining a variation pattern of the set room temperature; and a controller (42) for receiving the changed parameters from the parameter changing unit (142) and controlling the operation of the air conditioner according to the pleasant sleep driving mode having the variation pattern of the set room temperature determined by the changed parameters.

In the above air conditioner, the parameter changing unit changes the respective values of the parameters to set a reducing rate of the set room temperature and an increasing rate of the set room temperature, thereby selecting one of various pleasant sleep modes having different variation patterns of the set room temperature.

According to the air conditioner, the variation pattern of the set room temperature (for example, the reducing rate of the set room temperature and/or the increasing rate of the set room temperature) can be freely varied by each user, and thus different comfortable sleeping environments that are suitable for different users can be established.

In the above air conditioner, the parameter changing unit (142) has an end time setting unit (143) for setting an end time at which the pleasant sleep driving mode is scheduled to be finished.

In the above air conditioner, when a scheduled driving time of the pleasant sleep driving mode is input through the end time setting unit, the end time setting unit adds the present time with the scheduled driving time and outputs the end time of the pleasant sleep driving mode.

In the above air conditioner, the scheduled driving time of the pleasant sleep driving mode is set as a default value.

In the above air conditioner, the default value is changeable, and when the default value is changed to a new default value as the scheduled driving time, the air conditioner is subsequently operated in the pleasant sleep driving mode based on the new default value.

According to the above air conditioner, the end time setting unit inputs the scheduled driving time of the pleasant sleep driving mode, and adds the present time with the scheduled driving time to set the end time of the pleasant sleep driving mode. Therefore, by displaying this information on a display panel or the like, the user can easily judge in what time the pleasant sleep driving mode is finished from now, that is, at what time the pleasant sleep driving mode is finished.

BRIEF DESCRIPTION OF THE DRAWINGS

FIG. 3 is a diagram showing the construction of a remote controller, and set data of the remote controller.

DETAILED DESCRIPTION OF THE PREFERRED EMBODIMENT

A preferred embodiment according to the present invention will be described with reference to the accompanying drawings.

Figure 1:
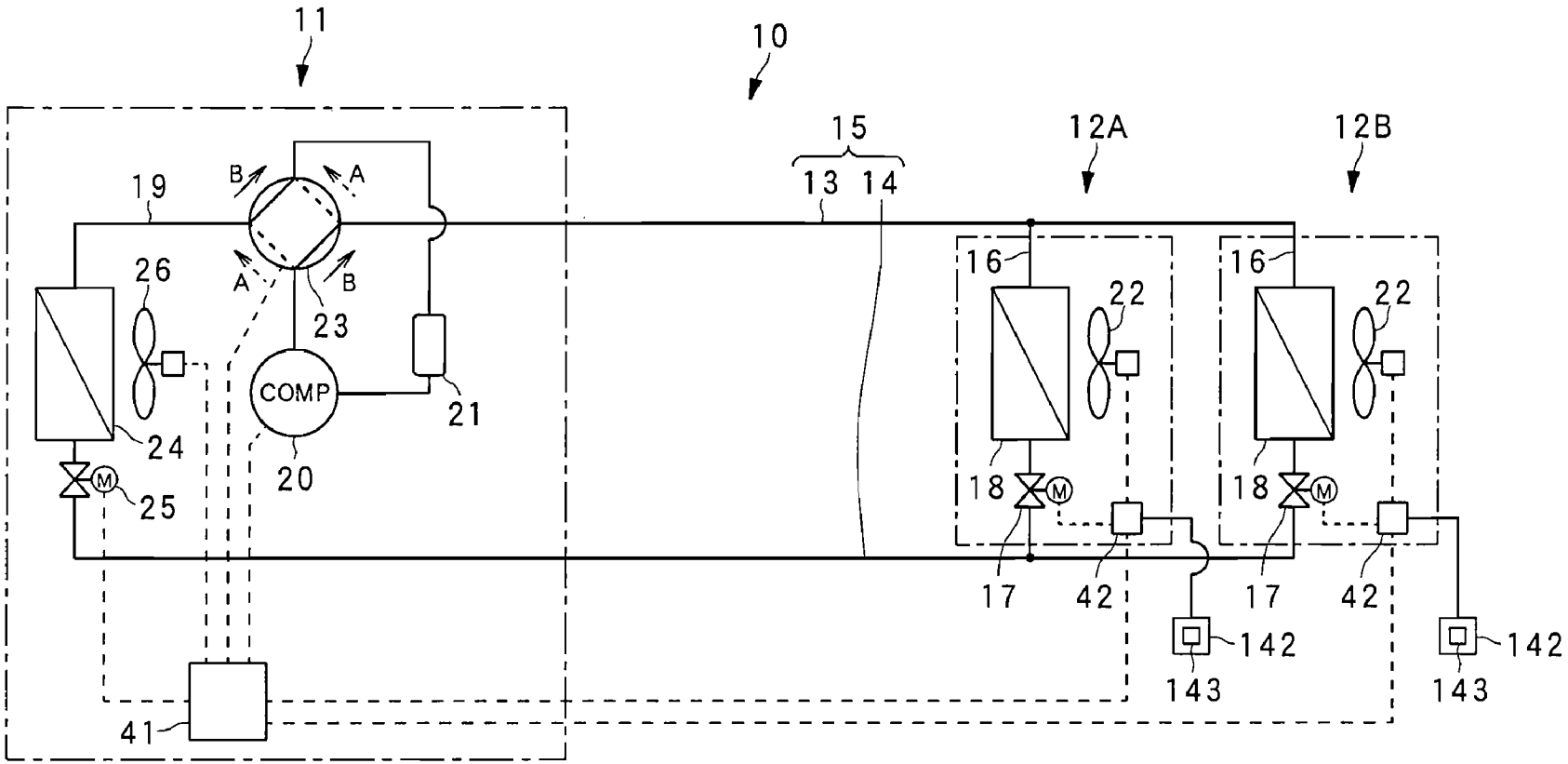
FIG. 1 is a systematic diagram showing the construction of an air conditioner according to an embodiment of the present invention.

FIG. 1 is a systematic diagram showing an air conditioner 10 according to an embodiment of the present invention. The air conditioner 10 is constructed by connecting an outdoor unit 11 to an inter-unit pipe 15 comprising a gas pipe 13 and a liquid pipe 14 and also connecting plural (two in FIG. 1) indoor units 12A and 12B to the inter-unit pipe 15 in parallel. Each of the indoor units 12A and 12B is constructed by an indoor electric expansion valve 17 and an indoor heat exchanger 18 disposed in an indoor refrigerant pipe 16. One end of the refrigerant pipe 16 is connected to the gas pipe 13, and the other end of the refrigerant pipe 16 is connected to the liquid pipe 14 through the indoor electric expansion valve 17. An indoor fan 22 for blowing air to the indoor heat exchanger 18 is disposed so as to be adjacent to the indoor heat exchanger 18. Furthermore, each of the indoor units 12A and 12B is provided with an indoor controller 42 for controlling the indoor electric expansion valve 17 and the indoor fan 22. The valve opening degree of the indoor electric expansion valve 17 is adjusted in accordance with an air-conditioning load.

The outdoor unit 11 is constructed by disposing a compressor 20 in an outdoor refrigerant pipe 19, disposing an accumulator 21 at the suction side of the compressor 20, disposing a four-way valve 23 at the discharge side of the compressor 20, and successively disposing an outdoor heat exchanger 24 and an outdoor electric expansion valve 25 in this order in the outdoor refrigerant pipe 19 at the four-way valve 23 side. An outdoor fan 26 for blowing air to the outdoor heat exchanger 24 is disposed so as to be adjacent to the outdoor heat exchanger 24.

The outdoor unit 11 is provided with an outdoor controller 41 for controlling the whole air conditioner 10. The outdoor controller 41 controls the compressor 20, the four-way valve 23, the outdoor electric expansion valve 25, the outdoor fan 26, etc., and transmits an instruction to the indoor controller 42 of each of the indoor units 12A and 12B to control the indoor electric expansion valve 17 and the indoor fan 22. Reference numeral 142 represents a remote controller, reference numeral 143 represents a dedicated button for setting a pleasant sleep driving mode described later, and the dedicated button 143 is disposed in the remote controller 142. As described later, the pleasant sleep driving mode is set through the remote controller 142, and parameters for implementing the pleasant sleep driving mode are set through the remote controller 142 and then transmitted from the remote controller 142 to the indoor controller 42 in a wired or wireless fashion.

The air conditioner 10 is set to a cooling operation mode (containing drying mode) or a heating operation mode by switching the four-way valve 23 under the control of the outdoor controller 41.

When the air conditioner 10 is set to the cooling operation mode or the drying operation mode, the four-way valve 23 is switched to a position indicated by a broken line, and refrigerant flows in the direction of an arrow A of broken line. The refrigerant discharged from the compressor 20 under the operation of the compressor 20 passes through the four-way valve 23 and reaches the outdoor heat exchanger 24, and it is condensed in the outdoor heat exchanger 24. The condensed refrigerant flows through the outdoor electric expansion valve 25 to the liquid pipe 14, distributes to the indoor units 12A and 12B, and passes through the indoor electric expansion valves 17 of these indoor units 12A and 12B to be reduced in pressure. Thereafter, the refrigerant is evaporated in the indoor heat exchanger 18 and the room is cooled. The refrigerant from the indoor heat exchangers 18 of the indoor units 12A and 12B flow together into the gas pipe 13, flows to the outdoor unit 11, passes through the four-way valve 23 and the accumulator 21 of the outdoor unit 11 and then returns to the compressor 20. Here, the outdoor electric expansion valve 25 is controlled to be substantially fully opened so that the pressure of the liquid refrigerant condensed in the outdoor heat exchanger 24 is not reduced, and the indoor electric expansion valves 17 are controlled to be closed in valve opening degree so as to promote evaporation of the refrigerant in the indoor heat exchangers 18. These series of steps will be hereinafter referred to as "control process under cooling operation".

Furthermore, when heating operation is set, the four-way valve 23 is switched as indicated by a solid line, and the refrigerant flows as indicated by an arrow B of solid line. Then, The refrigerant discharged from the compressor 20 by driving the compressor 20 is passed through the four-way valve 23 to the gas pipe 13. Then, the refrigerant flow is divided to the indoor units 12A and 12B, and the refrigerant is condensed in the respective indoor heat exchangers 18 of the indoor units 12A and 12B to heat the room. The refrigerant condensed in the indoor heat exchanger 18 is passed through the indoor electric expansion valves 17 and then flow together in the liquid pipe 14. Then, the refrigerant is made to flow to the outdoor unit 11, reduced in pressure by the outdoor electric expansion valve 25 of the outdoor unit 11, evaporated in the outdoor heat exchanger 24, passed through the four-way valve 23 and the accumulator 21 and then returned to the compressor 20.

Here, the indoor electric expansion valves 17 are controlled to be substantially fully opened so that the pressure of the liquid refrigerant condensed in the indoor heat exchangers 18 is not reduced, and the outdoor electric expansion valve 25 is controlled to be closed in valve opening degree so as to promote evaporation of the refrigerant in the outdoor heat exchanger 24. These series of steps will be hereinafter referred to as "control process under heating operation".

In this embodiment, the air conditioner 10 is provided with a pleasant sleep driving (hereinafter referred to as "night setback driving) mode. The night setback driving mode is set by pushing a dedicated button 143 provided to the remote controller 142 before a user goes to bed under cooling, drying or heating operation, for example. When the night setback driving mode is set, the room temperature is temporarily reduced, and then gradually increased as indicated by a broken line (A) of FIG. 2. Under the state that the room temperature is temporarily reduced, the body temperature of the user under sleep is promoted, and thereafter the room temperature is gradually increased to make such an environment that the increase of the body temperature of the user is promoted, thereby assisting the user to awake with a pleasantly refreshed feeling.

According to this embodiment, in the night setback driving mode, the reducing rate of the room temperature (° C./hour) (the rate of reducing the room temperature per unit time) and/or the increasing rate of the room temperature (° C./hour) (the rate of increasing the room temperature per unit time) can be freely adjusted (changed) by using the remote controller 142 serving as an adjusting unit. Furthermore, a default value of a scheduled driving time t in the night setback driving mode described later can be changed.

Figure 2:
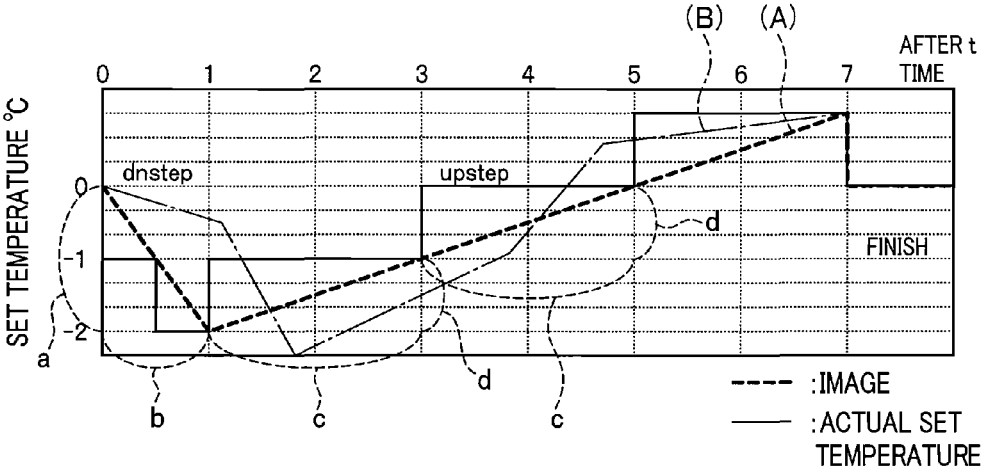
FIG. 2 is a diagram showing two different pleasant sleep driving modes.

FIG. 2 shows the variation of the set room temperature with respect to the time in two different night setback driving modes ((A), (B)). Here, the variation of the set room temperature represented by a broken line (A) in FIG. 2 will be first described.

In FIG. 2, respective parameters a, b, c and d used to determine an imaginary (idealistic) variation (behavior) of the room temperature represented by the broken line (A) are set so that a=2, b=1, c=2 and d=1. For example, according to this setting shown in FIG. 2, at a first step, the room temperature is reduced by a=2° C. in b=1 hour.

According to the actual variation of the set room temperature, when the dedicated button 143 is pushed during cooling, drying or heating operation, the set room temperature in the night setback driving mode is first set to a first temperature (−1° C. in FIG. 2) which is lower than the basic set temperature (0° C. (relative value) in FIG. 2) during cooling, drying or heating operation (i.e., in the normal driving mode) by 1° C., and the air conditioner is operated for 30 minutes under this state. Subsequently, the set room temperature is set to a second temperature which is lower than the first set temperature by 1° C. (that is, a temperature lower than the basic set temperature), and the air conditioner is further operated for 30 minutes under this state. In this case, the power of the air conditioner is controlled so that about 30 minutes is needed to reduce the room temperature by 1° C. According to this operation, the room temperature is reduced by 2° C. in one hour as indicated by a broken line (i.e., a/b=2(° C./hour)).

Thereafter, the variation of the room temperature turns to increase, and specifically the room temperature increases at the rate of d/c (=½=0.5)° C./hour. Specifically, the air conditioner is operated for 2 hours under the state that the set room temperature is lower than the basic set temperature by 1° C., further operated for 2 hours under the state that the set room temperature is set to the same temperature as the basic set temperature, and further operated for 2 hours under the state that the set room temperature is set to be higher than the basic set temperature by 1° C. In this case, the power of the air conditioner is controlled so that about 2 hours is needed to increase the room temperature by 1° C. According to this operation, the room temperature is increased at the rate of 1° C. per 2 hours (0.5° C. per hour) as indicated by the broken line. The scheduled driving time of the air conditioner in the night setback driving mode is set to seven hours, that is, the scheduled driving time t (=7 hours) is a default value and it is preset.

According to this embodiment, the parameters a, b, c and d and the default value t of the scheduled driving time in the night setback driving mode are freely changeable through the key operation of the remote controller 142 by the user as shown at the upper stage (A) of FIG. 3. This change is carried out according to the setting mode of EEPROM provided in the remote controller 142. First, a driving mode button 141 and a set button 242 out of various kinds of keys are continued to be pushed for four seconds at the same time. At this time, the setting mode of EEPROM is set, and "DN" is displayed on an item code display portion 45. This display is successively switched by pushing an up/down button 46, and each of "OB", "OC", "OD", . . . , "18" is successively displayed on the item code display portion 45 as shown at the lower stage (B) of FIG. 3. For example, when a timer up/down button 47 1s pushed under the state that "OB" is displayed on the item code display portion 45, any one of "0" and "1" is displayed on a set data display portion 48. The display of "0" means permission of the night setback driving operation, and the display of "1" means prohibition of the night setback driving operation. The same is applied to "OC", "OD", "OE".

When the default value of the scheduled driving time t in the night setback driving operation is changed, the up/down button 46 is continued to be pushed until "OF" is displayed on the item code display portion 45, and the timer up/down button 47 is pushed when "OF" is displayed. At the lower stage (B) of FIG. 3, the default value t=7 is displayed. However, when the timer up/down button 47 is pushed under the above state, this numeral (t=7) is successively changed, and thus the default value is changed. When the default value is changed to a new value, this new value is set to the scheduled driving time t for the subsequent night setback driving operation.

The setting/change of the respective parameters a, b, c and d is different between a case where the night setback driving operation is carried out under cooling or drying operation and a case where the night setback driving operation is carried out under heating operation. In the former case, the display of the item code display portion 45 is switched among "10" to "13", and in the latter case, the display of the item code display portion 45 is switched among "14" to "17".

When the timer up/down button 47 is pushed under the state that the display of the item code display portion 45 is switched to "10" or "14", the parameter a of the temperature is changed, and when the timer up/down button 47 is pushed under the state that the display of the item code display portion 45 is switched to "11" or "15", the parameter b of the time is changed.

Furthermore, when the timer up/down button 47 is pushed under the state that the display of the item code display portion 45 is switched to "12" or "16", the parameter d of the temperature is changed, and when the timer up/down button 47 is pushed under the state that the display of the item display portion 45 is switched to "13" or "17", the parameter c of the time is changed.

Next, a method of setting the night setback driving mode will be described.

This driving operation is carried out after various kinds of data settings shown at the lower stage (B) of FIG. 3 are completed.

Figure 4:
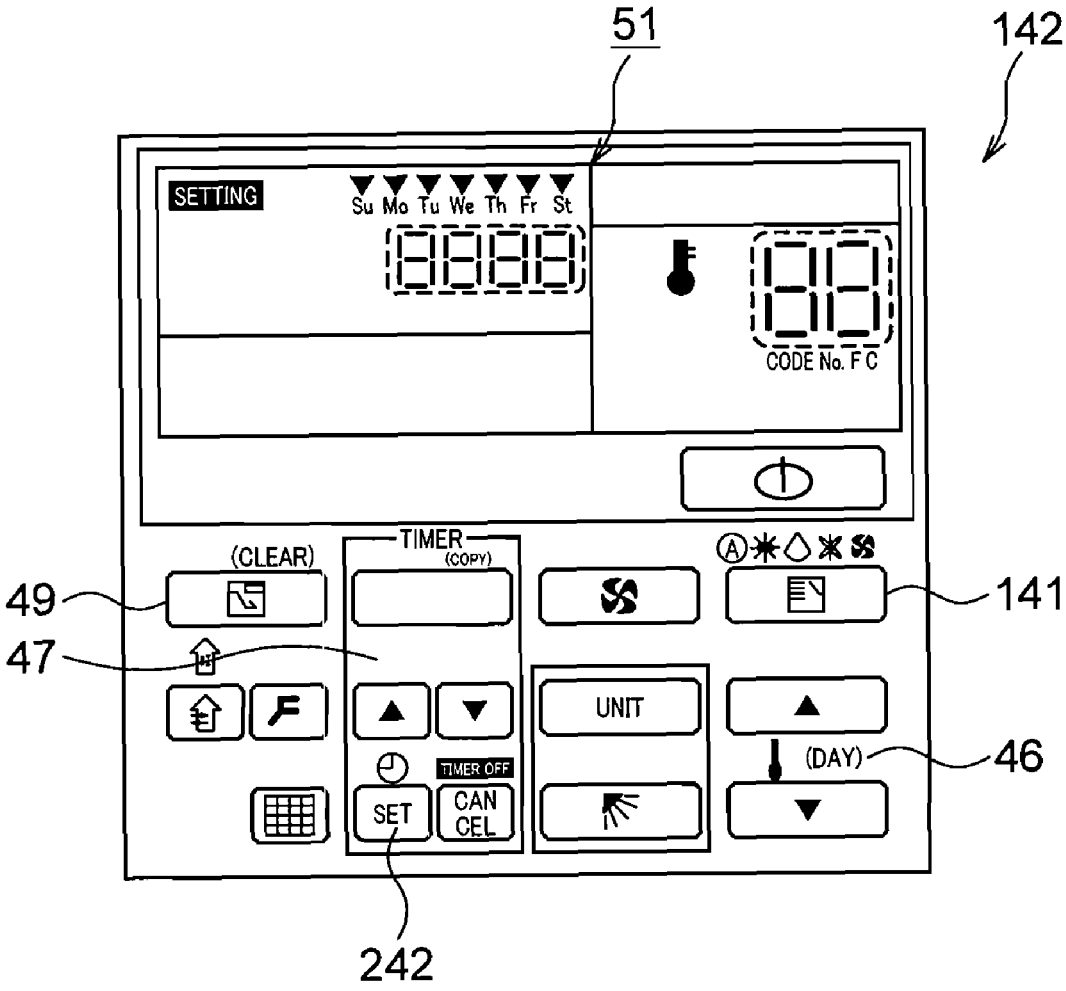
FIG. 4 is a diagram showing a night setback setting screen.

First, the dedicated button 143 is pushed. At this time, the screen of each of the display portions 45 and 48 is switched to a night setback setting screen 51 as shown in FIG. 4. When the default value t is set to 7, the actual end time of the driving operation, that is, "the present time+(default value t=7 hours)" is displayed on the setting screen 51. For example, the time (present time) at which the above setting is carried out is 22 o'clock, the end time of the night setback driving operation is equal to 22+7=29 o'clock (that is, 5 a.m.), and thus the end time of 5 a.m. is displayed on the setting screen 51. The calculation and the display are carried out by the remote controller (end time setting unit) 142.

When a scheduled driving time t other than the default value "7" is set, the screen is switched to the setting screen 51, and then the dedicated button 143 is pushed again. At this time, the actual driving end time is changed every time the dedicated button 143 is pushed, and the changed end time, that is, "the present time+ (t=7→6→5→4→3→2→1→10→9→8→7 . . . )" is displayed on the setting screen 51. The user pushes the up/down button 46 to determine a start set temperature after checking the end time, and pushes the set button to start the night setback driving operation. The night setback driving operation is released by pushing the dedicated button 143.

In this embodiment, when the scheduled driving time t is input, the scheduled driving time t is added to the present time to set the end time of the night setback driving operation, and the end time of the night set back driving operation is displayed on the setting screen 51. Therefore, the user can easily recognize in what time the actually set night setback driving mode is finished in, for example, at what time in the night the actually set night setback driving mode is finished, and thus the facilitation of the control and the operability can be enhanced.

Furthermore, according to this embodiment, the reducing rate of the room temperature and the increasing rate of the room temperature can be easily set by freely and independently setting the respective parameters a, b, c and d through the remote controller 142, and also the set values of the respective parameters a, b, c and d themselves can be freely changed. Furthermore, the number of parameters (four in this embodiment) itself to determine the pleasant sleep driving mode can be changed to any value.

Accordingly, for example, the variation pattern (style) of the set room temperature in FIG. 2 can be freely and individually changed (adjusted) by each individual user in accordance with his/her favorite sleeping condition. Specifically, the variation pattern of the set room temperature can be freely adjusted by changing the gradients of the straight lines indicated by the broken lines (A), the number of the straight lines (for example, two straight lines in FIG. 2), etc. Accordingly, a comfortable sleeping environment which is most suitable for an individual user can be established by selecting his/her most favorite night setback driving mode from various different night setback driving modes (different variation patterns of the set room temperature in FIG. 2) which are achieved by varying the parameters a, b, c, d, etc.

As described above, in the above-described embodiment, the parameters for determining the night setback driving mode are set to four (a, b, c and d). However, the number of the parameters is not limited to four, and it may be five or more. By increasing the number of the parameters, the variation pattern of the set room temperature can be more finely adjusted. For example, the variation pattern of the set room temperature can be adjusted so as to vary at plural times as indicated by a one-dotted chain line (B) This variation pattern can be established on the basis of ten parameters.

Furthermore, the night setback driving mode is provided to each of the plural indoor units 12A and 12B. Therefore, the night setback driving mode may be set to the plural indoor units 12A and 12B at the same time, or it may be independently set to each of the indoor units 12A and 12B. Furthermore, different night setback driving modes may be set to the plural indoor units 12A and 12B, respectively. Accordingly, the degree of freedom of the control can be enhanced.

What is claimed is:

1. An air conditioner having a sleep driving mode that enables an individual sleeping operation during sleeping and includes a temperature reducing mode in which a set room temperature is reduced and a temperature increasing mode in which the set room temperature is increased, comprising:

an end time setting unit for setting an end time at which the sleep drive mode is scheduled to be finished;

a parameter changing unit configured to freely change parameters that determine a rate of temperature reduction with respect to time until a freely-settable first desired time is reached, and that determine a rate of temperature increase with respect to time until a freely-settable second desired time is reached, the rate of temperature reduction and the rate of temperature increase with respect to time during the sleeping operation being freely changeable on the basis of the changeable parameters; and a controller configured to receive the changed parameters from the parameter changing unit and to control the operation of the air conditioner so that room temperature is varied according to the rate of temperature reduction and the rate of temperature increase during the sleeping operation, wherein said controller computes a constant descending slope to obtain a constant rate of temperature reduction with respect to time by using desired time and temperature input from a temperature input device which is configured to receive time and temperature inputs from a user, and further computes a constant ascending slope to obtain a constant rate of temperature increase with respect to time by using desired time and temperature input from the temperature input device, the room being kept at a set temperature for a given time on the basis of the constant rate of temperature reduction and the constant rate of temperature increase, wherein the sleep mode operation is executed by the controller when a sleep mode driving mode button is pushed, wherein the controller is always causing the temperature to constantly increase or constantly decrease.

2. The air conditioner according to claim 1, wherein the parameter changing unit changes the respective values of the parameters to set a reducing rate of the set room temperature and an increasing rate of the set room temperature, thereby selecting one of various sleep modes having different variation patterns of the set room temperature.

3. The air conditioner according to claim 1, wherein when a scheduled driving time of the sleep driving mode is input through the end time setting unit, the end time setting unit adds the present time with the scheduled driving time and outputs the end time of the sleep driving mode.

4. The air conditioner according to claim 3, wherein the scheduled driving time of the sleep driving mode is set as a default value.

5. The air conditioner according to claim 4, wherein the default value is changeable, and when the default value is changed to a new default value as the scheduled driving time, the air conditioner is subsequently operated in the sleep driving mode based on the new default value.

6. The air conditioner according to claim 1, wherein a new slope is computed at every set temperature and time interval.

7. An air conditioner having a sleep driving mode that enables an individual sleeping operation during sleeping and includes a temperature reducing mode in which a set room temperature is reduced and a temperature increasing mode in which the set room temperature is increased, comprising:

a parameter changing unit configured to freely change parameters for determining a linear reducing rate of temperature with respect to time at which temperature is linearly reduced until a freely-settable first desired time is reached, and to determine a linear increasing rate of temperature with respect to time at which temperature is linearly increased from the first desired time until a freely-settable second desired time is reached, the linear reducing rate of temperature and the linearly increasing rate of temperature with respect to time during the sleeping operation being freely changeable on the basis of the changeable parameters; and a controller configured to receive the changed parameters from the parameter changing unit and to control the operation of the air conditioner so that room temperature is varied according to the linear reducing rate of temperature and the linear increasing rate of temperature determined on the basis of the changed parameters during the pleasant sleeping operation, and wherein said controller uses an inputted time and temperature and computes a slope such that by a set time, the room will be at the set temperature, and wherein said slope is a change in temperature divided by change in time, wherein the sleep mode operation is executed by the controller when a sleep mode driving mode button is pushed, wherein the controller is always causing the temperature to constantly increase or constantly decrease.

8. The air conditioner according to claim 7, wherein a new slope is computed at every set temperature and time interval.

* * * * *